United States Patent [19]

Bar-Nefy et al.

[11] Patent Number: 4,727,940

[45] Date of Patent: Mar. 1, 1988

[54] TANK MOUNTED MINE-FIELD CLEARING APPARATUS

[75] Inventors: Simcha Bar-Nefy, Omer; Michael Tiomkin; Aron Klipper, both of Beersheva, all of Israel

[73] Assignee: Israel Aircraft Industries, Ltd., Lod, Israel

[21] Appl. No.: 808,372

[22] Filed: Dec. 13, 1985

Related U.S. Application Data

[63] Continuation of Ser. No. 557,530, Dec. 2, 1983, abandoned.

[30] Foreign Application Priority Data

Dec. 9, 1982 [IL] Israel ..... 67437

[51] Int. Cl.[4] ..... F41H 11/16

[52] U.S. Cl. ..... 171/84; 172/4; 172/33; 172/766; 171/101; 89/1.13

[58] Field of Search ..... 171/84, 87, 88, 50, 171/46, 16, 9, 101; 198/832, 791, 789; 172/33, 777, 811, 766; 89/1.13

[56] References Cited

U.S. PATENT DOCUMENTS

| | | | |
|---|---|---|---|
| 1,268,314 | 6/1918 | Barton | 172/33 |
| 1,423,887 | 1/1922 | Stewart | 414/443 X |
| 2,160,972 | 6/1939 | Litchy | 37/275 |
| 2,298,671 | 10/1942 | Bayes | 172/33 |
| 2,322,115 | 6/1943 | Cox | 172/766 X |
| 2,388,015 | 10/1945 | Shoemaker | 414/443 |
| 2,425,357 | 8/1947 | Walker | 89/1.13 |
| 2,460,322 | 2/1949 | Walker | 89/1.13 |
| 2,479,719 | 8/1949 | Boylan | 171/19 |
| 2,486,372 | 10/1949 | Rockwell | 172/777 |
| 2,489,349 | 1/1949 | White | 89/1.13 |
| 2,747,306 | 5/1956 | Hasenbuhler | 172/33 |
| 3,106,793 | 10/1963 | Savage | 172/33 |
| 3,238,647 | 3/1966 | Hall | 172/816 |
| 3,771,413 | 11/1973 | Sieg | 89/1.13 |
| 4,279,138 | 7/1981 | Van Der Lely et al. | 172/4 |
| 4,372,441 | 2/1983 | Krammer | 198/789 |
| 4,384,620 | 5/1983 | Uchida | 172/815 |
| 4,552,053 | 11/1985 | Bar-Nefy et al. | 89/1.13 |

FOREIGN PATENT DOCUMENTS

| | | | |
|---|---|---|---|
| 83630082.2 | 5/1982 | European Pat. Off. . | |
| 82303792.4 | 5/1983 | European Pat. Off. . | |
| 2430709 | 8/1976 | Fed. Rep. of Germany | 89/1 M |
| 2632568 | 1/1978 | Fed. Rep. of Germany | 89/1 M |
| 914285 | 10/1946 | France . | |

OTHER PUBLICATIONS

Jane's Combat Support Equipment, 1st Ed. 1978–1979 Ed. C. F. Foss Macdonald & Jane's Pubs. Ltd, London 1978 p. 178.

Minenraum-Anbangerat KMT-5 Soldat und Technik 4/1976 pp. 176–178.

*Primary Examiner*—Richard T. Stouffer
*Assistant Examiner*—Bradley M. Lewis
*Attorney, Agent, or Firm*—Cushman, Darby & Cushman

[57] ABSTRACT

Mine clearing apparatus for attachment to a vehicle and comprising a frame mountable onto a vehicle for selectable positioning in a raised or lowered orientation; apparatus mounted onto the frame for raising and shunting aside mines including a plow section, the plow section defining a plurality of plow teeth which, in operation, extend below the ground surface, and conveyer apparatus extending along the length of the plow section and adapted to convey the contents of the earth raised by the plow section to one side of the vehicle.

9 Claims, 4 Drawing Figures

TANK MOUNTED MINE-FIELD CLEARING APPARATUS

This is a continuation of application Ser. No. 557,530, filed Dec. 2, 1983, now abandoned.

FIELD OF THE INVENTION

The present invention relates to apparatus for clearing mines, and more particularly to mine clearing apparatus mountable on an armoured vehicle such as a tank.

BACKGROUND OF THE INVENTION

There is described and claimed in applicant's copending Israel Patent Application No. 63437 from which priority is claimed in U.S. Pat. No. 4,467,694 apparatus for clearing mines which overcomes the difficulties and disadvantages of conventional prior art mine clearing techniques and apparatus and which comprises a frame mountable onto a vehicle for selectable positioning in a raised or lowered orientation; apparatus for raising and shunting aside mines mounted onto the frame; and apparatus for selectably retaining the frame in a raised orientation and comprising control apparatus operable from inside the vehicle for releasing the frame from the raised orientaiton and allowing it to assume the lowered orientation.

There is also described and claimed in applicant's copending Israel Patent Application No. 64023 from which priority is claimed in U.S. Pat. No. 4,491,053 apparatus for clearing mines comprising a frame mountable onto a vehicle for selectable positioning in a raised or lowered orientation; plow apparatus for raising and shunting aside mines mounted onto the frame; and apparatus for automatically raising the plow from its lowered orientation to its raised orientation in response to backwards motion of the vehicle and including mounting apparatus rotatably mounted onto the vehicle, spring supporting apparatus mounted onto the mounting apparatus and attached to the plow aparatus; and tooth apparatus fixed onto the mounting apparatus and arranged for selectable engagement with the vehicle tread, the spring supporting apparatus being operative when the plow is in its lowered orientation to urge the tooth apparatus into driven engagement with the vehicle tread whereby during backwards movement of the vehicle, the mounting apparatus rotates in a first direction, thereby extending the length of the spring supporting apparatus, and increasing the spring force thereof until a spring force is reached at a first position of the mounting apparatus sufficient to raise the plow to its raised orientation. Continued rotation of the mounting apparatus raises the plow until it engages a retaining hook, and is held stationary.

In addition, there is described and claimed in applicant's co-pending Israel Patent Application No. 65824 from which priority is claimed in U.S. Pat. No. 4,552,053 mine clearing apparatus for attachment to a vehicle and comprising a frame mountable onto a vehicle for selectable positioning in a raised or lowered orientation; apparatus mounted onto the frame for raising and shunting aside mines including first and second plow sections disposed one above another in hinged engagement, the second plow section being associated with a plurality of plow teeth which, in operation, extend below the ground surface, the first and second plow sections being operative to lie in generally the same plane during operation and in folded engagment when the frame is in its raised orientation, the raising and shunting aside apparatus being mounted on the frame in front of the ground engaging members on each side of the vehicle and being angularly oriented to have a forward edge adjacent the interior of the vehicle and a rearward edge adjacent the side edge of the vehicle, each of the forward edges being provided with a chain attached to the first and second plow sections such as to be tensioned when the first and second plow sections are in their operating orientations to thereby define a barrier against mines passing from adjacent the forward edge to the relatively unprotected area at the interior of the vehicle.

SUMMARY OF THE INVENTION

The present invention seeks to provide various improvements to the aparatus for clearing mines described in the aforementioned co-pending Israel Patent Applications.

There is thus provided in accordance with a preferred embodiment of the present invention mine clearing apparatus for attachment to a vehicle and comprising a frame mountable onto a vehicle for selectable positioning in a raised or lowered orientation; apparatus mounted onto the frame for raising and shunting aside mines including a plow section, the plow section defining a plurality of plow teeth which, in operation, extend below the ground surface, and conveyor apparatus extending along the length of the plow section and adapted to convey the contents of the earth raised by the plow section to one side of the vehicle.

According to a preferred embodiment of the invention, the plow teeth define a steeply slanting upper surface entending downwardly from the conveyor apparatus such that mines buried in the earth will progress upwardly along the slanting surface onto the conveyor apparatus while the surrounding earth will fall between adjacent teeth.

Further in accordance with a preferred embodiment of the invention, the mine clearing apparatus is provided with control apparatus for controlling the depth of the plow section during operation.

BRIEF DESCRIPTION OF THE DRAWINGS

The apparatus of the present invention will be further understood and appreciated from the following detailed description taken in conjunction with the drawings in which.

DETAILED DESCRIPTION OF THE INVENTION

Figure 1:
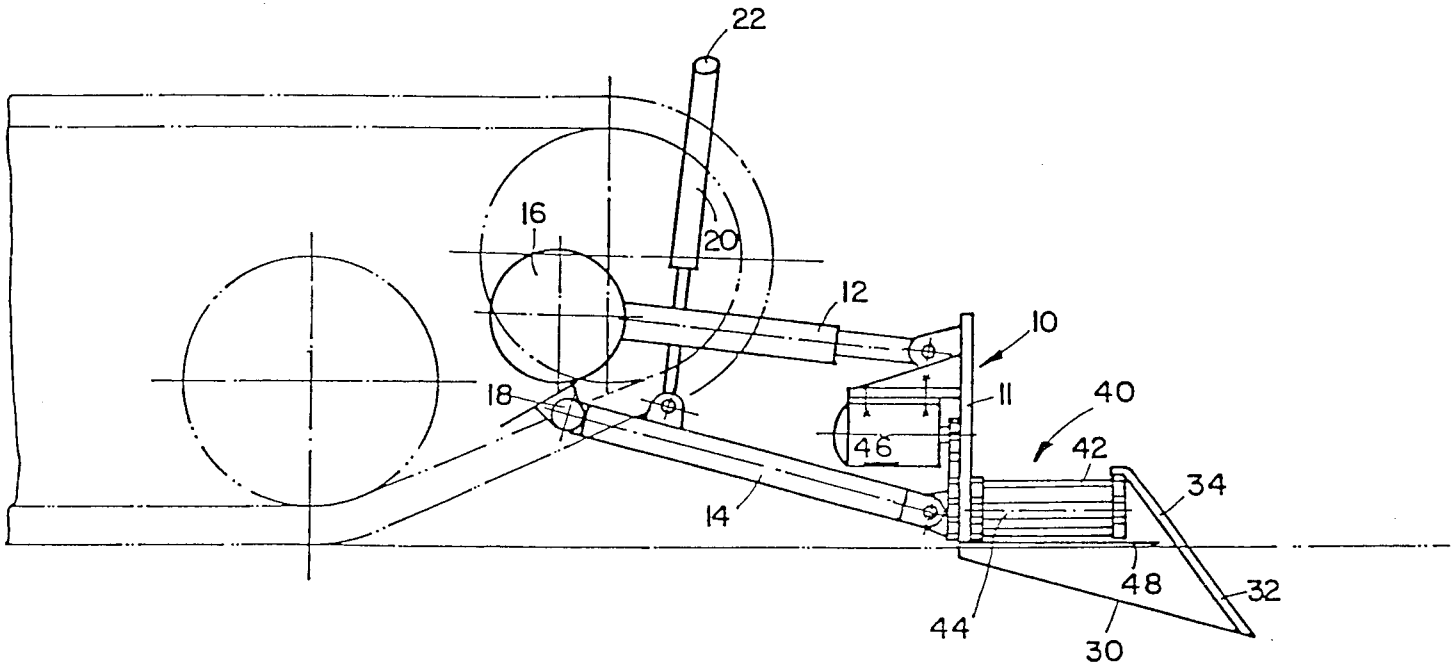
FIG. 1 is a side view illustration of a mine clearing apparatus constructed and operative in accordance with an embodiment of the present invention, with the plow portion in a lowered orientation.
Figure 2:
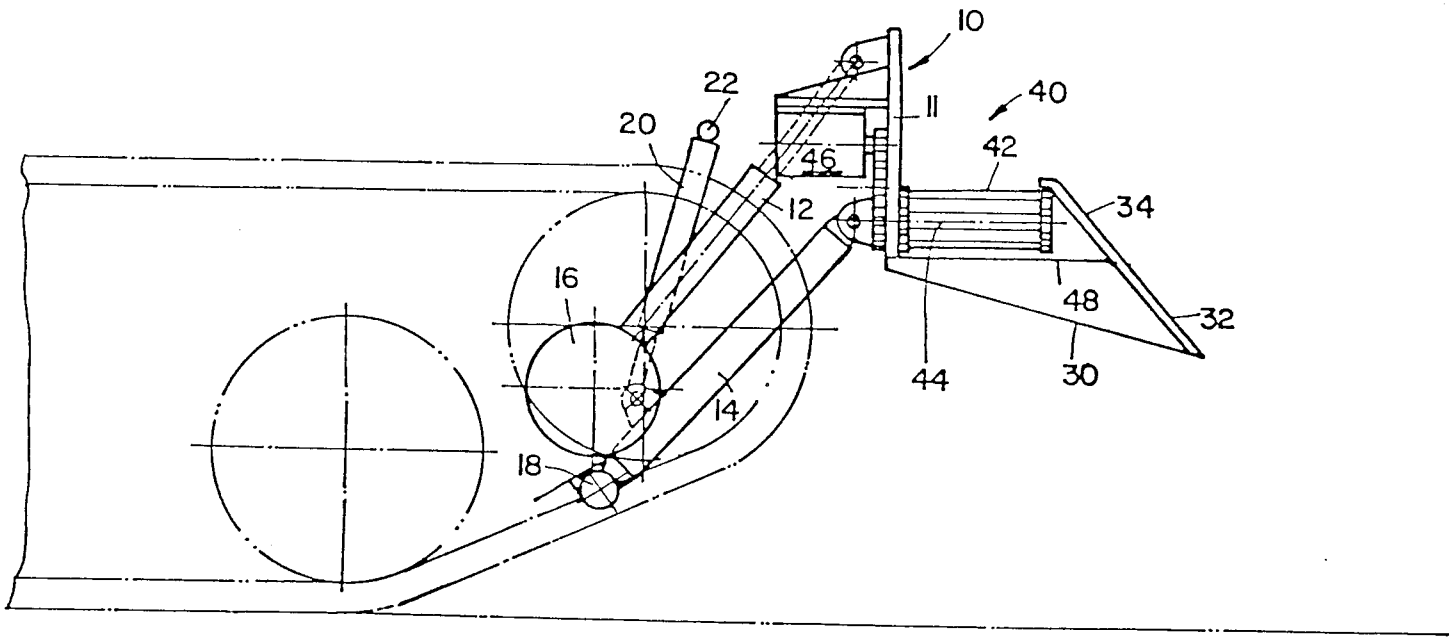
FIG. 2 is an illustration of the mine clearing apparatus of FIG. 1 with the plow portion in a raised orientation.
Figure 3:
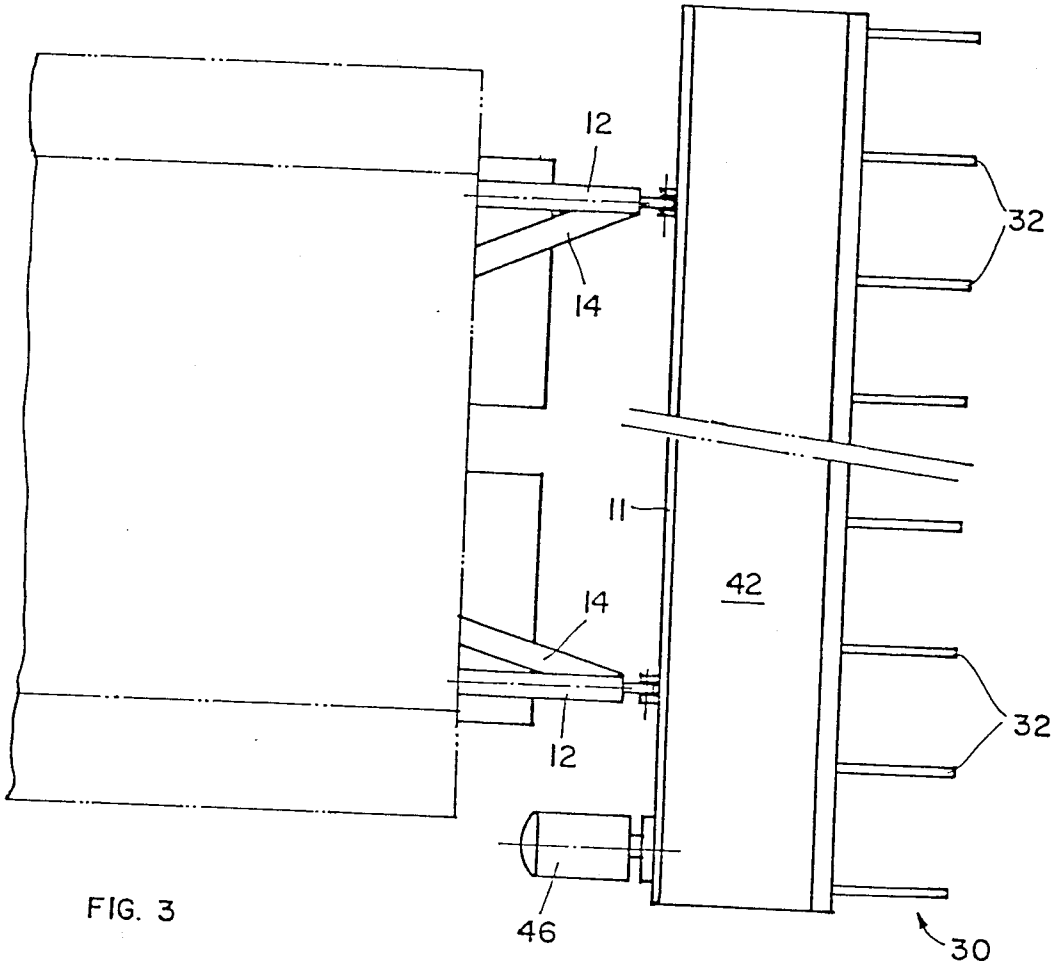
FIG. 3 is a top view illustration of the mine clearing apparatus of FIGS. 1 and 2.

Reference is now made to FIGS. 1–3 which illustrate mine clearing apparatus constructed and operative in accordance with an embodiment of the present invention. The present description is presented with particular reference to mine clearing apparatus which is mountable onto a particular type of tank, the M-60 Patton. It is appreciated that this is entirely for the purpose of illustration and that the invention is applicable to other types of tanks and possibly other vehicles as well.

As seen in the illustrations, the mine clearing apparatus comprises a frame generally designated 10. Frame 10 includes a back wall 11 and is rotatably mounted onto an armoured vehicle, such as an M-60 tank in the illustrated embodiment, such as by means of pistons 12 and rods 14 affixed to either side of frame 10. Pistons 12 and rods 14 are pivotably affixed to the chassis of the tank at respective pivot locations 16 and 18. Rod 14 is also coupled to the hull of the tank by means of a second piston 20 which is affixed to the hull at location 22. It will be appreciated that movement of frame 10 by means of pistons 12 and 20 can be effected from within the vehicle by conventional means. Alternatively, any other means of rotatable attachment may be utilized, for example, both attachment means may be rods or pistons, or the element designated 12 might be a rod and that designated 14 a piston.

Mounted upon frame 10 is a plow portion 30 which extends across the front of the vehicle from one side to the other. Plow portion 30 defines a plurality of forwardly extending teeth 32. Teeth 32 define a sharply slanted upper portion 34 which leads onto conveyor apparatus 40.

Conveyor apparatus 40 may be of conventional construction and comprises a continuous belt 42 which extends the length of the plow portion. Belt 42 is of conventional manufacture and may comprise a plurality of overlapping iron plates or may be made of any other suitably strong material. Continuous belt 42 is mounted about two drums 44 which, in a preferred embodiment, permit rotation of the belt in either a clockwise or counterclockwise direction. Drums 44 are activated as by motor 46. Alternatively, conveyor apparatus 40 may comprise a shaking surface whose vibration causes the debris thereon to slowly move along the surface until it falls off the side edge of the belt.

It is a particular feature of the apparatus of the present invention that a path the width of a tank (i.e., four and a half meters) may be cleared in one pass. Prior art mine clearing apparatus were unable to do this satisfactorily because the power required to plow the earth across the entire front of the mine clearing apparatus is much greater than a tank is capable of expending. (Such clearance is possible using a tractor, but the use of a tractor provides the driver with no protection and has other disadvantages.) Thus, such apparatus when mounted on tanks were only capable of clearing a tread-wide path, one behind each tread. The apparatus of the present invention does not push the earth ahead of it so requires much less power, as described in greater detail hereinbelow.

Another disadvantage of prior art apparatus is that a mine clearing apparatus which plows the earth and the mines therein to either side of the plow apparatus necessarily leaves two banks along the path which are full of mines. It is virtually impossible with conventional mine clearing apparatus to widen such a path. Since the mine clearing apparatus of the present invention clears all the mines and debris to one side thereof, the path behind it may be widened by another plow following along behind which shunts all the debris off to the other side. Thus, A path as wide as eight meters can be cleared by two tank-mounted apparatus of the present invention, one plowing behind and to the side of the other with the paths slightly overlapping.

It is a further particular feature of the apparatus of the present invention that it is capable of clearing away mines of all sorts, including antenna mines, magnetic field mines and traditional pressure-sensitive mines. Mine clearing apparatus of the prior art were unable to clear away antenna mines or magnetic field mines which were buried between their treads and, when the apparatus passed over the mines, they detonated, damaging the mine clearing apparatus.

Plow portion 30 additionally comprises a plate 48 which underlies conveyor apparatus 40. Plate 48 serves to protect the conveyor apparatus from damage from below and separates the lower portion of teeth 32 from the upper, sharply slanted portion 34.

The method of operation of the mine clearing apparatus can be seen with reference to FIGS. 1 to 3. The tank or other mine clearing vehicle carries the frame 10 in the raised orientation of FIG. 2 to the location to be cleared. It will be appreciated that frame 10 is mounted such that the view of the driver of the vehicle is not obscured by the mine clearing apparatus when in the raised orientation.

Upon arrival at the site to be cleared, the frame 10 is lowered until the lower portion of teeth 32 on plow portion 30 enter the earth. Raising and lowering and positioning of the frame 10 and plow portion 30 are accomplished by any suitable means. In the illustrated embodiments, these are accomplished by means of pistons 12 and 20 and rods 14. Piston 20 serves to lift and lower rod 14 which pivots about pivot location 18 and raises or lowers frame 10. Piston 12 pivots about pivot location 16 and serves to adjust the approach angle of plow portion 30 to the ground. Alternatively, any other lifting and positioning mechanism may be utilized to adjust the frame, such as hydraulic, electrical, mechanical or winch mechanisms.

As the vehicle moves forward, teeth 32 move downward and forward through the earth. The horizontal spacing between adjacent teeth 32 is selected to be such that dirt and small bits of debris will pass therebetween, falling back to the ground, but anti-vehicle mines and other large objects such as rocks will of necessity be engaged thereby. The mines and large objects will roll up along teeth 32 and will be pushed by the continued forward movement of the vehicle and the pressure of the earth being plowed along the upper portion 34 of teeth 32 onto belt 42 of conveyor apparatus 40. Back wall 11 of frame 10 serves to retain this debris on belt 42. It will be appreciated that plow portion 30 preferably progresses along the ground at such a height that plate 48 underlying conveyor apparatus 40 moves slightly above the ground level.

The large debris, including mines, which has moved onto the conveyor belt 42 is carried by movement of the belt to either side of the vehicle where it falls off by means of gravity and remains along one side of the path cleared by the vehicle. In a preferred embodiment, conveyor belt 42 is bi-directional so that the debris may be shunted to either side as desired in each particular location.

It is a particular feature of the present invention that relatively little power is required to shunt to the side mines and large debris from an area the entire width of the tank. Only such power as is needed to drive the conveyor belt is required, so that not much power is drained from the tank or other vehicle for this purpose.

This provides much greater efficiency and speed of clearing than prior art devices which required a tremendous amount of energy to plow to the side the mines along with most of the earth in which they were buried.

It will be appreciated by those skilled in the art that bumpiness of the ground can cause the area to be inadequately cleared. In other words, in certain spots, the plow portion will sink lower into the earth than in others. Furthermore, the plow portion will have a tendency to dig progressively deeper and deeper into the earth due to its weight and the suction forces inherent in plowing. In order to prevent this from occurring, depth control apparatus to control the teeth depth may be provided.

Figure 4:
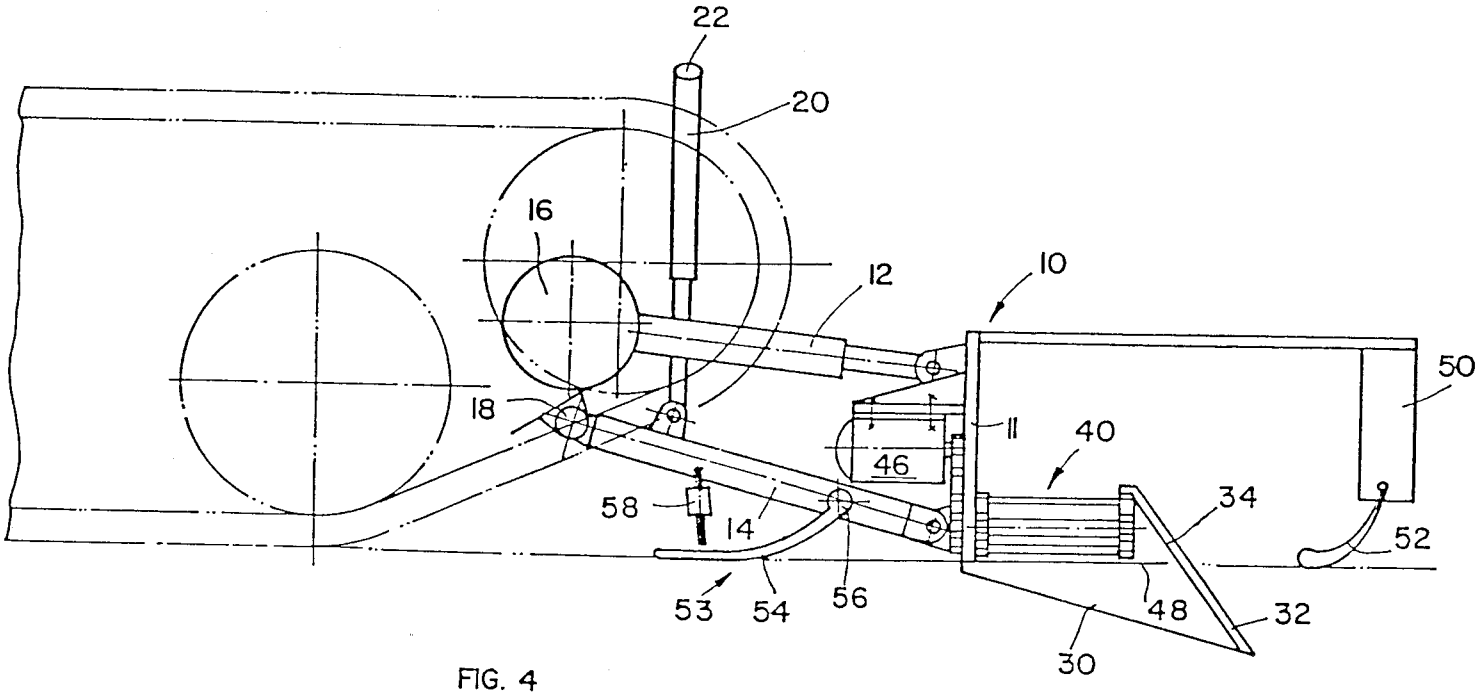
FIG. 4 is a side view illustration of a mine clearing apparatus constructed and operative in accordance with a preferred embodiment of the present invention and including depth control apparatus.
Figure 1:
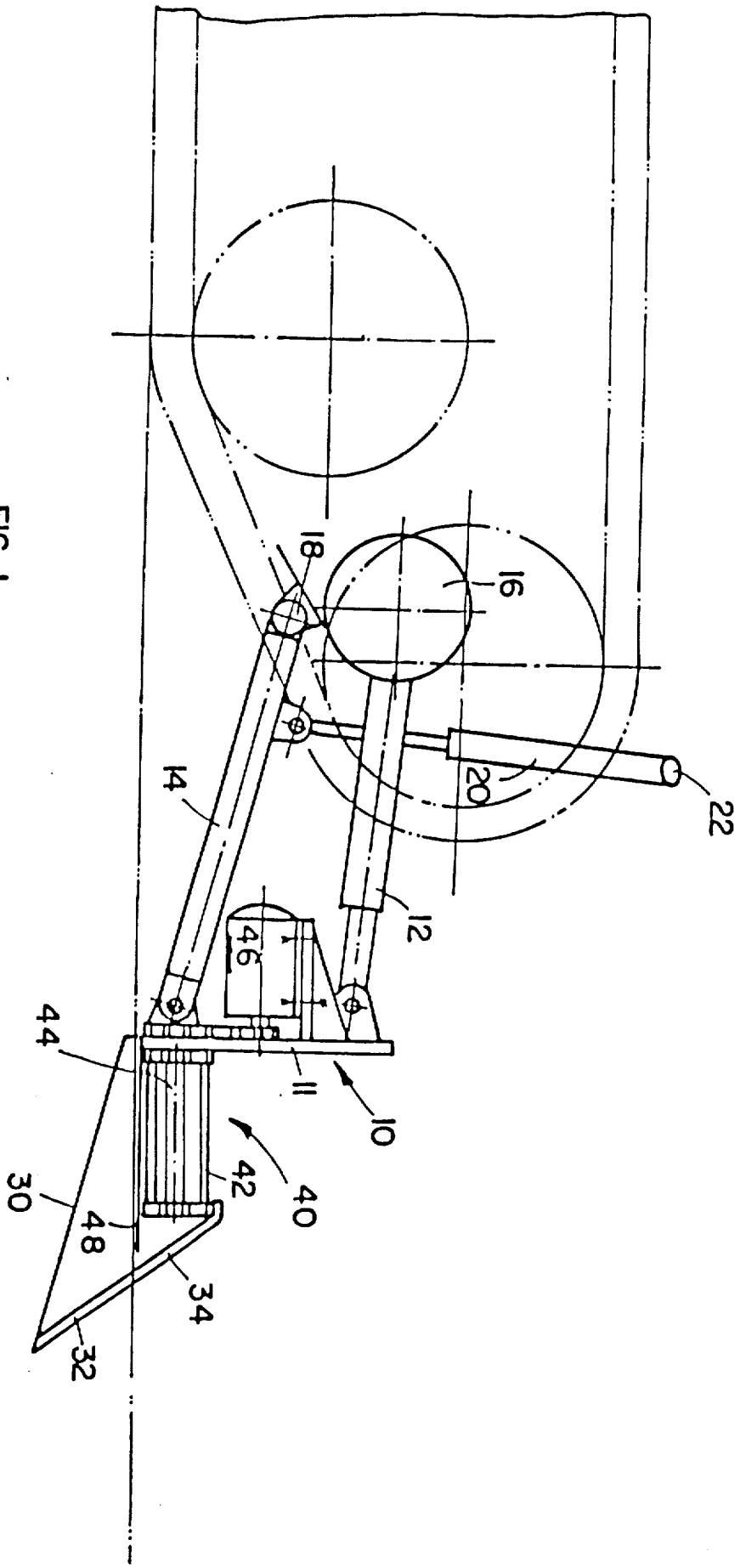
Figure 2:
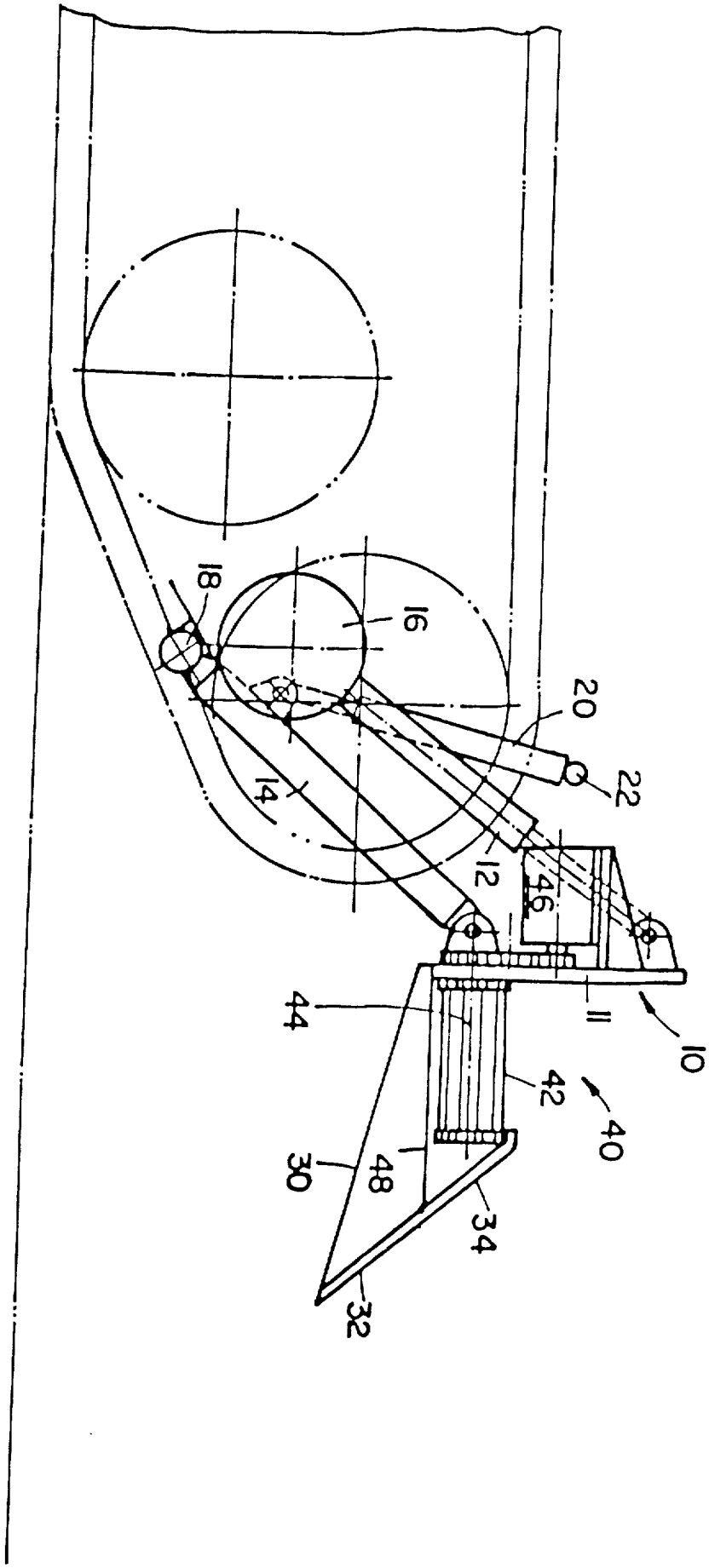
Figure 3:
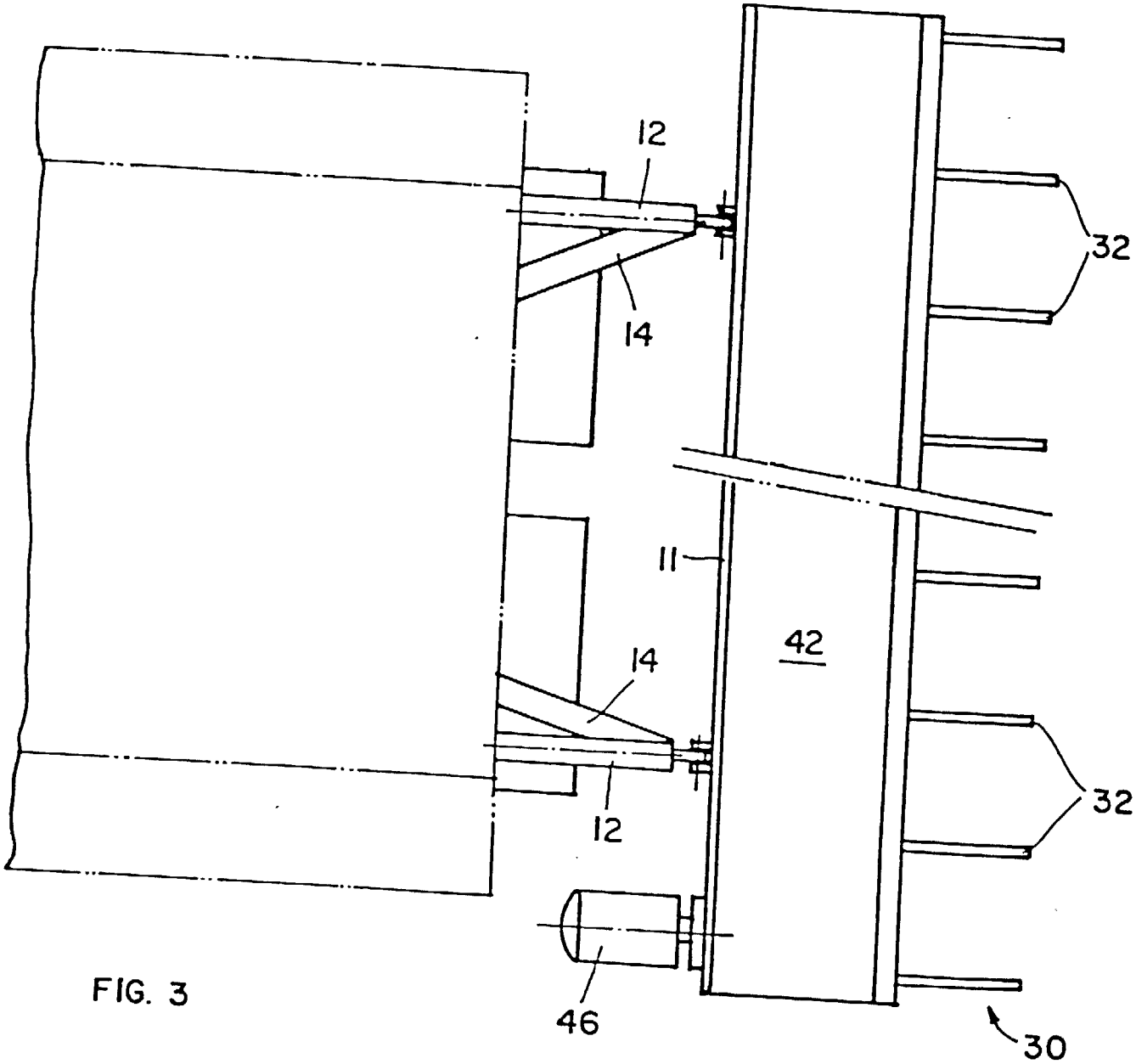
Figure 4:
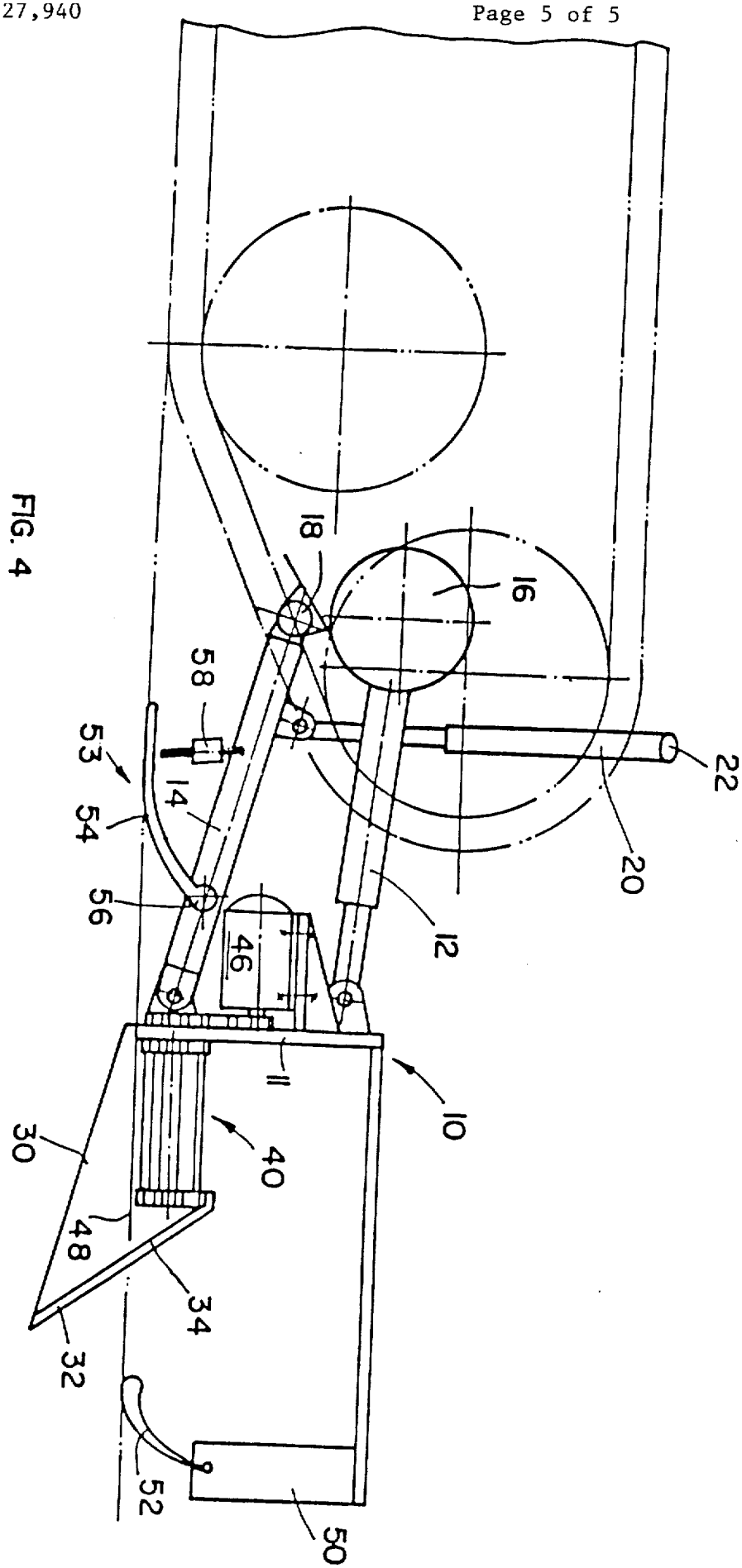

With reference to FIG. 4 there is shown a mine clearing apparatus constructed and operative in accordance with the present invention and including such control mechanisms. In all other aspects, it is substantially identical to the apparatus of FIGS. 1 to 3, and like parts have like reference numerals.

The mine clearing apparatus of FIG. 4 comprises a frame 10 including a back wall 11 which is rotatably mounted onto an armoured vehicle, such as an M-60 tank in the illustrated embodiment, as by means of a piston 12 and rod 14 affixed to either side of frame 10.

The desired depth of operation for teeth 32 is determined by means of a gliding surface assembly 53 which is articulatedly mounted onto each of lifting means 14. The gliding surface assembly 53 comprises a wing-shaped sled 54 which is pivotably mounted onto rods 14 and is arranged to slide on the ground surface rearwardly of the plow portion and of teeth 32. A piston and cylinder combination 58 which is mounted onto each respective rod 14 and sled 54 determines the orientation of the sled relative to the respective arm so as to maintain the teeth 32 at a predetermined operating depth.

The operation of piston and cylinder combination 58 is controlled in such a way that the teeth 32 do not tend to dig deeper and deeper into the ground surface. One way to accomplish this end is to provide a ground surface sensor 50 associated with microswitches 52 which are mounted on either side ahead of the mine clearing apparatus in such a way as to trace a path along the ground to be cleared. Microswitches 52 respond to the presence and/or absence of contact between the sensor and the ground surface and provide a control function through suitable conventional logic control circuitry to the piston and cylinder combination 58, which preferably is hydraulically operated. Other types of sensors, such as ultrasonic, laser or electrical sensors, may also be employed.

It will be appreciated by those skilled in the art that the scope of the present invention is not limited by what has been shown and described hereinabove by way of illustration. Rather, the scope of the invention is limited solely by the claims which follow.

We claim:

1. A tank having a selectably operated mine clearing capability comprising:

a tank;

a frame mountable onto said tank for selectable positioning in a raised or lowered orientation;

apparatus mounted onto the frame for raising and shunting aside mines along the entire width of tank including:

a plow section disposed in front of the tank and extending along the entire width of the tank and generally perpendicular to the direction of movement of the tank;

a conveyor apparatus located directly behind the plow section, extending generally in a horizontal plane along the length thereof and generally coextensive therewith;

a protective plate underlying said conveyor apparatus;

said plow section defining a plurality of spaced plow teeth including a forwardly extending lower portion which, in a operation extends from below the ground surface to the conveyor surface, and a sharply slanted upper portion which leads to the conveyor surface, said protective plate separating said upper portion of said teeth from said lower portion of teeth, said plow section including said plow teeth and said conveyor apparatus cooperating to convey the contents of the earth raised by the plow section to one side of said vehicle.

2. Mine clearing apparatus according to claim 1 and wherein said conveyor apparatus comprises a motorized, bi-directional conveyor.

3. Mine clearing apparatus according to claim 1 and wherein said frame further comprises a back wall adapted to retain the raised contents of the earth upon said conveyor apparatus.

4. Mine clearing apparatus according to claim 1 and further comprising control means for controlling the depth of the plow section during operation.

5. Mine clearing apparatus according to claim 4 and wherein said control means comprises:

ground surface sensor means adapted to sense the presence or absence of contact between said sensor means and the ground and provide a position control function in response thereto;

a gliding surface supporting said frame in its lowered orientation, said gliding surface being disposed rearwardly of the apparatus for raising and shunting aside mines; and positioning means for governing the orientation of said gliding surface relative to said frame in response to said control function.

6. Apparatus according to claim 1 and wherein said plurality of spaced plow teeth is arranged to have a spacing such that dirt and small bits of debris will pass therebetween but anti-vehicle mines and other large objects will be engaged thereby.

7. Apparatus according to claim 1 and wherein said protective plate is arranged to lie slightly above ground level during operation.

8. Apparatus according to claim 1 and also comprising depth control apparatus comprising a gliding surface assembly including a sled arranged to slide on the ground surface rearwardly of said plow section and a piston and cylinder combination mounted onto said frame and onto said sled for controlling the relative orientation thereof.

9. Apparatus according to claim 8 and wherein said depth control apparatus comprises a ground surface sensor and microswitch means providing control information for governing the operation of said piston and cylinder combination.

* * * * *

UNITED STATES PATENT AND TRADEMARK OFFICE

CERTIFICATE OF CORRECTION

PATENT NO. : 4,727,940

DATED : March 1, 1988

INVENTOR(S) : Simcha Bar-Nefy, Michael Tiomkin and Aron Klipper

It is certified that error appears in the above-identified patent and that said Letters Patent is hereby corrected as shown below:

Delete the unrelated drawing on the reverse side of the Title Page and substitute correct drawings, including Figures 1, 2, 3 and 4.

Signed and Sealed this

Fifteenth Day of November, 1988

*Attest:*

*Attesting Officer*

DONALD J. QUIGG

*Commissioner of Patents and Trademarks*